United States Patent [19]

Martin

[11] 4,071,163

[45] Jan. 31, 1978

[54] APPARATUS FOR RECOVERING PAINT SPILLS

[76] Inventor: Michael Martin, 24 Jefferson St., Attleboro, Mass. 02703

[21] Appl. No.: 721,460

[22] Filed: Sept. 8, 1976

[51] Int. Cl.[2] ..... B65D 47/40

[52] U.S. Cl. ..... 220/69; 220/85 R; 220/85 H; 215/100.5

[58] Field of Search ..... 222/173, 108, 186, 192, 222/424, 570; 220/85 H, 90, DIG. 6, 287, 69, 85 R; 215/100.5

[56] References Cited

U.S. PATENT DOCUMENTS

| | | | |
|---|---|---|---|
| 229,467 | 6/1880 | Rembot | 215/100.5 UX |
| 1,997,529 | 4/1935 | Miller | 220/85 H |
| 2,837,256 | 6/1958 | Daner | 220/90 X |
| 3,309,000 | 3/1967 | Haverstick | 222/570 X |
| 3,407,429 | 10/1968 | DiNardo | 215/100.5 X |
| 3,807,457 | 4/1974 | Logsdon | 220/287 X |

*Primary Examiner*—Stanley H. Tollberg
*Assistant Examiner*—Norman L. Stack, Jr.

[57] ABSTRACT

Apparatus for recovering paint spills is disclosed comprising a receptacle adapted to fit about the bottom of a paint can, the receptacle having side walls extending for a distance beyond the outer periphery of the bottom of the paint can to which such apparatus is attached to provide a gutter for catching paint spills. The apparatus may be held in place against a paint can by means of straps which may be secured to the rim of the can and a pouring spout may be provided in the receptacle to empty the receptacle of an accumulation of paint spills.

5 Claims, 3 Drawing Figures

FIG. 1
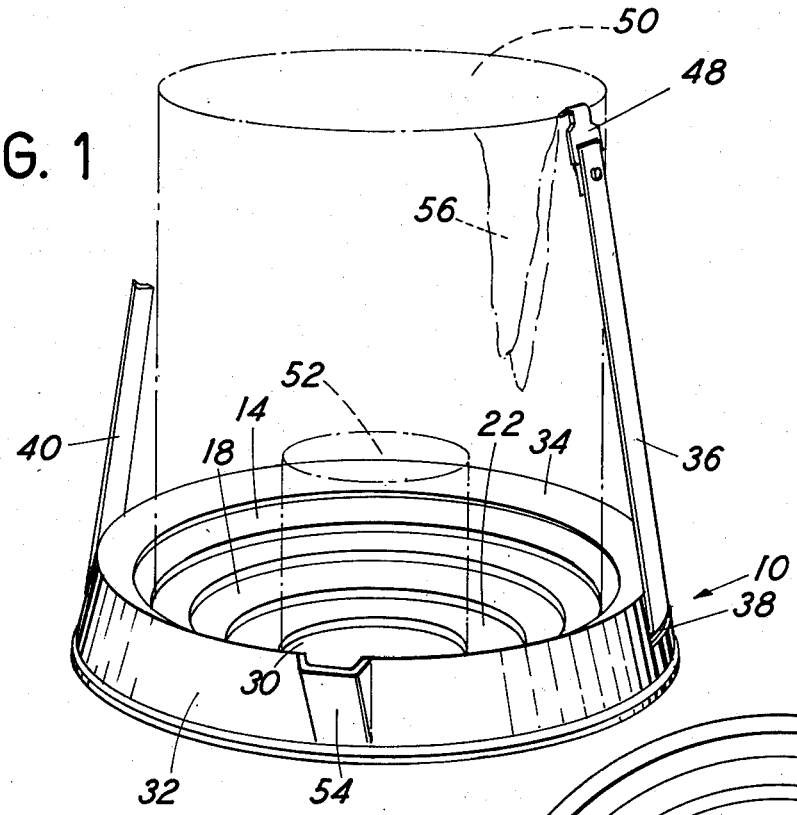
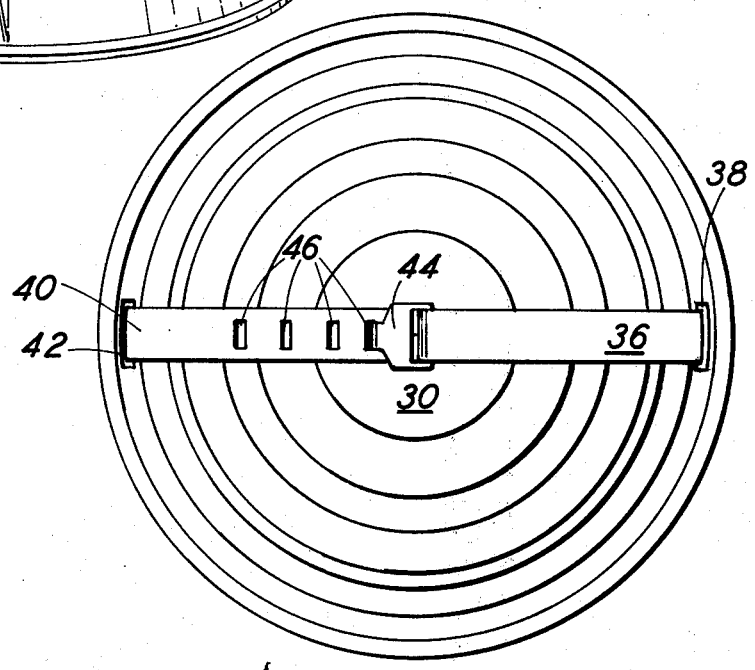
FIG. 2
FIG. 3
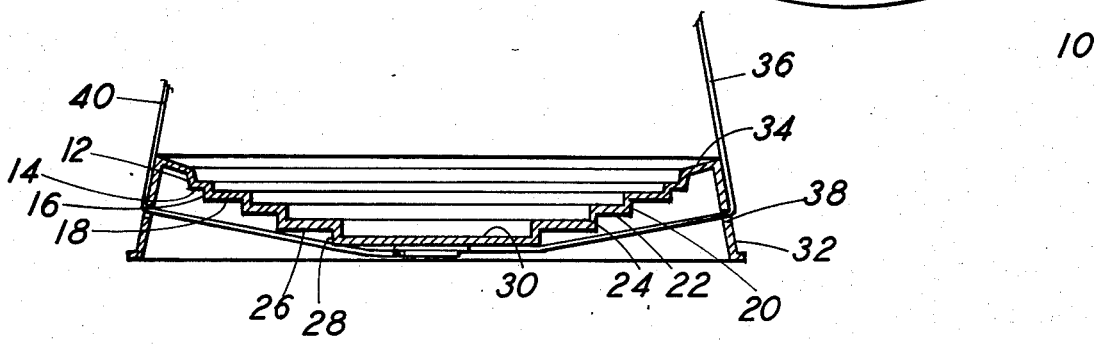

APPARATUS FOR RECOVERING PAINT SPILLS

SUMMARY OF THE INVENTION

The present invention relates to apparatus for recovering paint spills from paint cans comprising a receptacle to fit about the bottom of a paint can, the receptacle having side walls extending for a distance beyond the outer periphery of the bottom of a paint can to which such apparatus may be attached thereby to provide a gutter for catching paint spills. Members are provided for securing the apparatus to a paint can.

The side wall members may be adapted to hold any of a plurality of paint cans of varying sizes.

The side wall members comprise a plurality of side walls, the diameter and shape of which corresponds to the bottom walls of paint cans of varying sizes. In this instance, the diameter of the bottom walls is intended to mean the span covering the greatest distance between opposed side walls. In the most common embodiment, the side walls are circular in shape to correspond to the bottom of paint cans most commonly in use. The first of the side walls has a flange projecting inwardly at the bottom thereof to join the upper outer edge of an intermediate side wall means in a stepwise manner. The intermediate side wall means extends downwardly from the flange of the first of said side walls, an intermediate side wall flange means projecting inwardly in a stepwise manner from the bottom of said intermediate side wall means. Any of a plurality of intermediate side wall means and intermediate side wall flange means may be employed, each succeeding intermediate side wall means and intermediate side wall flange means extending downwardly and inwardly in a stepwise fashion. The intermediate side wall means and the intermediate side wall flange means provide a surface to receive any one of a plurality of paint can bottom walls. The intermediate side wall means and flange means terminate in a last side wall. The bottom edge of the last side wall extends inwardly to form a bottom wall of the receptacle.

Another supporting wall may be provided extending upwardly from the base of the receptacle and especially upwardly from the plane in which the bottom wall of the receptacle lies to supportingly abut the side wall means.

The outer supporting wall may supportingly abut and extend into the outer periphery of the first side wall.

Members are provided for securing the apparatus to a paint can and may comprise an adjustable strap extending from the apparatus into securing abuttment with a paint can underneath which the apparatus is positioned.

The upper ends of the strap may terminate in a pair of hooks for engaging the rim of a paint can underneath which said apparatus is positioned.

The strap may comprise a resilient strap.

A spout may be provided on the side walls for pouring any accumulation of paint spills out of the receptacle.

BRIEF DESCRIPTION OF THE DRAWING

FIG. 1 is a perspective view illustrating apparatus for recovering paint spills from a paint can comprising a receptacle adapted to fit around the bottom of a paint can, the receptacle having side walls extending for a distance beyond the outer periphery of the bottom of a paint can to provide a gutter for catching paint spills according to one embodiment of the present invention, FIG. 2 comprises a bottom elevation of apparatus for recovering paint spills from a paint can and showing in some detail an adjustable strap secured to the receptacle for holding the receptacle in position against the bottom of a paint can according to one embodiment of the invention; and FIG. 3 comprises a side elevation partially in section of an apparatus for recovering paint spills comprising a receptacle adapted to fit about the bottom of a paint can, the side walls of the receptacle extending for a distance beyond the outer periphery of the bottom of a paint can to provide a gutter for catching paint spills according to another embodiment of the present invention.

DETAILED DESCRIPTION OF THE PREFERRED EMBODIMENT

Pouring spouts attachable to the upper openings of paint cans are disclosed in the prior art U.S. Pat. Nos. 3,899,107 Gaal; 3,356,266 Pinter, Jr.; 3,326,409 Speer; 3,309,000 Haverstick; 2,837,256 Daner; 2,786,614 Giusto; 2,674,391 Davis and 2,520,549 Jacobsen.

None of the foregoing references describe apparatus suitable for catching paint spilled from a can after the can has been opened and while the can is in use. All of these references teach apparatus attachable to the upper opening of a paint can to enable the contents of such a can to be poured without spillage. It is common knowledge that prolonged use of a paint can eventually results in a certain portion of paint being spilled over the edges due to the insertion and removal of a brush into the contents of a can during a painting operation. None of the foregoing references addresses itself to solving the problem of preventing such spills or for conserving paint that has been lost from the can in this manner.

It is therefore an object of the present invention to overcome these and other difficulties encountered in the prior art.

It is a further object of the present invention to provide apparatus for recovering paint spills from a paint can occassioned by the use of the can during brush applications or other applications requiring insertion of an applicator into the can several times during the course of paint application.

It is also an object of the present invention to provide a novel apparatus for recovering paint spills from a paint can comprising a receptacle adapted to fit about the bottom of a paint can as distinguished from the prior art method of providing pouring spouts securable to the outer periphery of the opening in the top of a paint can in order to minimize spillage.

These and other objects have been achieved according to the present invention and will become apparent by reference to the disclosure and claims that follow as well as the appended drawing.

Referring to the drawing and FIGS. 1–3, apparatus 10 is illustrated for recovering paint spills from a paint can and comprises a receptacle adapted to fit about the bottom of a paint can such as paint cans 50 or 52 illustrated in phantom configuration in FIG. 1. A paint spill 56 on can 52 also illustrated in phantom configuration in FIG. 1 running in the direction of the apparatus 10. The apparatus 10 has a plurality of side walls comprising a first side wall 12 and intermediate side walls 16, 20, 24 and a last side wall 28 extending for a distance beyond the outer periphery of the bottom of a paint can such as paint can 50 or paint can 52 to which the apparatus 10 is attached to provide a gutter for catching paint spills.

The arrangement of the aforementioned side walls is such that they are adapted to hold any of a plurality of paint cans of varying sizes such as those illustrated as paint can 50 or paint can 52 in FIG. 1.

The side walls of the apparatus 10 comprise a plurality of side walls, the diameter of which corresponds to the diameter of the bottom walls of paint cans of varying sizes such as paint can 50 or paint can 52, the first of the side walls 12 having a flange 14 projecting inwardly at the bottom of first side wall 12 to join the upper outer edge of the first of a plurality of intermediate side wall means such as side wall 16, the intermediate side wall 16 extending downwardly from the flange 14 of the first of said side walls 12. Intermediate side wall flange means are provided projecting inwardly in a stepwise manner from the bottom of the intermediate side wall means such as intermediate side wall flange means 18 projecting inwardly from the bottom of the intermediate side wall means 16. Similarly, the other intermediate side wall 20 extends downwardly and then inwardly as intermediate side wall flange 22, intermediate side wall flange 22 then extending downwardly into intermediate side wall 24 in stepwise fashion to intermediate side wall flange 26. The last of the side walls comprises side wall 28 extending downwardly from the edge of intermediate side wall flange 26 and then inwardly to bottom wall 30 of the receptacle of the apparatus 10. Any of a plurality of intermediate side walls and intermediate side wall flanges may be provided in the apparatus depending upon the various types of cans that are to be used in conjunction with the apparatus 10.

An outer supporting wall 32 extends upwardly from the base of the apparatus 10 and especially upwardly from the plane in which the bottom wall 30 lies to supportingly abut any of the side wall members. In the embodiment illustrated, the outer supporting wall 32 supportingly abuts and extends into the outer upper periphery of the first side wall 12 through a connecting flange 34 which is canted inwardly and downwardly and which may also serve as a gutter. Members are provided for securing the apparatus 10 to a paint can and comprise in one embodiment a first adjustable strap 36 terminating in a hook 44 at the bottom of apparatus 10 and a second adjustable strap 40 terminating in a plurality of openings 46 into which the hook 44 may be inserted to adjust the length of the straps 36 and 40. Strap 36 extends through the outer supporting wall 32 through an opening 38 and strap 40 extends through the outer supporting wall 32 through an opening 42, both straps 36 and 40 terminating in metal hooks 48, (the hook in which strap 40 terminates not being illustrated) for securing the straps 36 and 40 to the upper edge of a receptacle such as a paint can. In one embodiment, either one or both of the straps 36 and 40 may comprise rubber straps. A spout 54 extends upwardly from the bottom wall 30 for pouring out any of the contents out of the receptacle of the apparatus 10.

In use, any of a plurality of paint cans having a bottom wall of the same configuration and of the same dimension as any of the side walls 12, 16, 20, 24 and 28 may be inserted in the apparatus and secured thereto by means of the adjustable straps 36 and 40 hooked over the upper rim of such receptacle as is illustrated by way of example in FIG. 1 in which the paint can 50 is secured to the apparatus 10 by means of straps 36 and 40. Any paint spilled during the application of the contents of the can 50 by means of a brush will be collected in the gutterlike arrangement of the receptacle side walls and flanges at the bottom of the paint can.

Although the invention has been described by reference to some embodiments, it is not intended that the novel apparatus for recovering paint spills be limited thereby but that modifications thereof are intended to be included as falling within the broad spirit and scope of the foregoing disclosure, the following claims and the appended drawing.

I claim:

1. Apparatus for recovering paint spills from a paint can comprising a receptacle adapted to fit about the bottom of a paint can, said receptacle having a plurality of side wall means extending for a distance beyond the outer periphery of the bottom of a paint can to which such apparatus is attached to provide a gutter for catching paint spills, and to hold any of a plurality of paint cans of varying sizes, said plurality of side wall means each having a diameter which corresponds to the diameters of the bottom walls of paint cans of varying sizes, the first of said side wall means having a flange projecting inwardly at the bottom thereof to join the upper outer edge of intermediate side wall means in a stepwise manner, said intermediate side wall means extending downwardly from the flange of said first of said side wall means, intermediate side wall flange means projecting inwardly in a stepwise manner from the bottom of said intermediate side wall means, said intermediate side wall means and said intermediate side wall flange means providing a surface to receive any one of a plurality of paint can bottom walls, the bottom edge of the last of said side wall means extending inwardly to form a bottom wall of said receptacle, means for securing said apparatus to a paint can.

2. The apparatus of claim 1 where said means for securing said apparatus to a paint can comprises an adjustable strap extending from said apparatus into securing abuttment with a paint can underneath which said apparatus is positioned.

3. The apparatus of claim 2 where the upper ends of said strap terminate in a pair of hooks for engaging the rim of a paint can underneath which said apparatus is positioned.

4. The apparatus of claim 3 where said strap comprises a resilient strap.

5. The apparatus of claim 1 further comprising a pouring spout operatively positioned in said side wall means for pouring an accumulation of paint spills out of said receptacle.

* * * * *